US011464267B2

(12) United States Patent
Schmidt

(10) Patent No.: US 11,464,267 B2
(45) Date of Patent: Oct. 11, 2022

(54) DEVICE AND METHOD FOR HANDLING FRAGMENTS OF A BROKEN NEEDLE

(71) Applicant: Groz-Beckert KG, Albstadt (DE)

(72) Inventor: Reiner Schmidt, Albstadt (DE)

(73) Assignee: GROZ-BECKERT KG, Albstadt (DE)

( * ) Notice: Subject to any disclaimer, the term of this patent is extended or adjusted under 35 U.S.C. 154(b) by 107 days.

(21) Appl. No.: 16/468,498

(22) PCT Filed: Dec. 1, 2017

(86) PCT No.: PCT/EP2017/081264
§ 371 (c)(1),
(2) Date: Jun. 11, 2019

(87) PCT Pub. No.: WO2018/108591
PCT Pub. Date: Jun. 21, 2018

(65) Prior Publication Data

US 2020/0068972 A1 Mar. 5, 2020

(30) Foreign Application Priority Data

Dec. 14, 2016 (DE) ..... 102016124293.4

(51) Int. Cl.
*A41H 19/00* (2006.01)
*D05B 91/12* (2006.01)
(Continued)

(52) U.S. Cl.
CPC ..... *A41H 19/00* (2013.01); *D05B 91/12* (2013.01); *A41H 31/00* (2013.01); *B65D 85/24* (2013.01);
(Continued)

(58) Field of Classification Search
CPC .... D05B 91/12; B65D 85/24; D05D 2305/36; A41H 19/00; A41H 31/00
See application file for complete search history.

(56) References Cited

U.S. PATENT DOCUMENTS 3,982,631 A 9/1976 Kunik et al.
4,798,152 A 1/1989 Simons et al.
(Continued)

FOREIGN PATENT DOCUMENTS

CN 1186239 A 7/1998
CN 101109137 A 1/2008
(Continued)

OTHER PUBLICATIONS

English translation of JP2005021473 to Sakaki, Jan. 2005, obtained via patents.google.com, last accessed Sep. 15, 2021. (Year: 2021).*
(Continued)

*Primary Examiner* — Alissa L Hoey
*Assistant Examiner* — Patrick J. Lynch
(74) *Attorney, Agent, or Firm* — Fitch, Even, Tabin & Flannery LLP

(57) ABSTRACT

A device (40) and a method is described for handling fragments (10) of a broken needle (11), for example in the context of a needle exchange of a broken needle (11) for a new needle (17). The fragments (10) of the broken needle (11) are arranged in a container (16) in a predetermined position. An image (32) of the fragments (10) of the broken needle (11) is then recorded with the aid of a camera (23). The recorded image (32) is stored for documentation (32) at at least one storage location and/or analysed as to whether all the fragments (10) of the broken needle (11) are present. After recording the image (32), the container (16) is closed in order to avoid the fragments (10) of the needle (11) being lost away from the sewing workstation.

28 Claims, 7 Drawing Sheets

(51) Int. Cl.

| | |
|---|---|
| ***B65D 85/24*** | (2006.01) |
| *A41H 31/00* | (2006.01) |
| *D05B 81/00* | (2006.01) |

(52) U.S. Cl.
CPC ..... *D05B 81/00* (2013.01); *D05D 2207/06* (2013.01); *D05D 2305/36* (2013.01); *D05D 2305/50* (2013.01)

(56) References Cited

U.S. PATENT DOCUMENTS

| | | | | |
|---|---|---|---|---|
| 5,918,559 | A * | 7/1999 | Sakino | D05B 83/00 112/235 |
| 5,923,165 | A | 7/1999 | Horita et al. | |
| 9,144,466 | B2 * | 9/2015 | McElhinny | A61B 50/30 |
| 10,443,171 | B2 | 10/2019 | Schmidt et al. | |
| 2009/0317002 | A1 * | 12/2009 | Dein | A61B 50/36 382/224 |
| 2014/0026379 | A1 * | 1/2014 | Herzog | B23P 19/04 28/115 |
| 2015/0252505 | A1 | 9/2015 | Schmidt et al. | |
| 2016/0044246 | A1 * | 2/2016 | Yamada | G03B 5/00 348/349 |
| 2018/0091782 | A1 * | 3/2018 | Bashkin | G07C 9/00563 |
| 2018/0185025 | A1 * | 7/2018 | Gorek | A44C 5/00 |

FOREIGN PATENT DOCUMENTS

| | | | |
|---|---|---|---|
| CN | 202175846 | U | 3/2012 |
| CN | 104919103 | A | 9/2015 |
| DE | 202014006932 | U1 | 11/2015 |
| EP | 2177121 | A1 | 4/2010 |
| JP | H07-185176 | A | 7/1995 |
| JP | 3016654 | U | 10/1995 |
| JP | 2005021473 | A * | 1/2005 |
| WO | 2014/044847 | A1 | 3/2014 |

OTHER PUBLICATIONS

Marc Spiwak, Camcorders: A General Overview, 2012, B & H, https://www.bhphotovideo.com/explora/video/buying-guide/camcorders-general-overview (last accessed Jan. 10, 2022) (Year: 2012).*

International Search Report dated Feb. 9, 2018, in corresponding International Patent Application No. PCT/EP2017/081264 (10 pages).

Chinese First Office Action dated Feb. 24, 2021, in corresponding Chinese Application No. 201780077105.9, with English translation (9 pages).

European Office Action dated Dec. 2, 2020, in corresponding European Application No. 17808464.6, with machine English translation (12 pages).

Japanese Notification of Reasons for Rejection dated Jul. 29, 2021, in corresponding Japanese Application No. 2019-529207, with English translation (11 pages).

Indian Office Action dated Dec. 29, 2021, in corresponding Indian Application No. 201917022641 (5 pages).

Chinese Office Action dated Jan. 14, 2022, in corresponding Chinese Application No. 201780077105.9, with machine English translation (16 pages).

* cited by examiner

DEVICE AND METHOD FOR HANDLING FRAGMENTS OF A BROKEN NEEDLE

CROSS REFERENCE TO RELATED APPLICATIONS

This patent application is the national phase of PCT/EP2017/081264, filed Dec. 1, 2017, which claims the benefit of German Patent Application 10 2016 124 293.4, filed Dec. 14, 2016.

TECHNICAL FIELD

The present invention refers to a device as well as a method for handling fragments of a broken needle.

BACKGROUND

Such a method is, for example, known from WO 2014/044847 A1. There a container with a holding magnet is used at which the fragments of the needle are aligned. In doing so, the initial needle is reconstructed, so to say. Based on the arrangement of the fragments in the container, it is evaluated whether all of the fragments have been found by a person.

This device or this method respectively, have already contributed to simplification and an improvement when sewing textiles, e.g. clothes. Because in case of a needle fracture, it has to be ensured that all of the fragments of the needle have been found and no fragment of the needle remains in the textile material.

Starting from the prior art it can be considered as object of the present invention to further improve the handling of fragments in the event of a needle fracture.

SUMMARY

According to the invention, it is proposed to arrange the fragments of the broken needle in a container in a predefined position. In this predefined position a picture of the fragments is captured by a camera. This picture is used for documentation and/or evaluation. For example, it can be stored or transmitted to a central computing unit for storage. Additionally, the possibility exists to automatically evaluate whether all of the fragments of the needle are present using image evaluation methods. For this the fragments can be compared with one or more geometric data of target geometry of the needle for example.

Due to the documentation of the needle fracture by the captured image, the recycling is improved. Gluing of the fragments by an adhesive film onto a carrier for the purpose of documentation is no longer necessary. Rather the needle fragments can be supplied to recycling without impurity.

By the device or the method the needle stock can be indicated actually in the central computing unit respectively. Order procedures for replacement purchase of needles at a needle manufacturer can be initiated in due course, also automatically. Concurrently, used needles can be directly assigned to the respective manufacturing orders and the data can be evaluated accordingly.

The electronic storage of the needle fractures documented by the picture simplifies and improves the proof of the proper handling of broken needles. The data can be easily linked with all necessary information as, e.g. the manufacturing order, and can be stored and archived locally and/or distant from the textile plant on one or more storage devices or computers respectively. Access to a portion or all of the stored data can be granted to authorized third persons. The access can be granted online.

The container has a main body and a cover. The cover is preferably pivotable between a close position and an open position or moveably guided and/or supported at the main body in another way. The main body has a top that, in the close position, is covered by the cover such that a reception space for the fragments is closed. Preferably a locking means can be provided that is configured to keep the cover in its close position at the main body by force and/or form-fit such that the container does not open and remains closed, even when falling from a height of one or two meters onto the ground. At the main body a retaining magnet is arranged that creates a magnetic field for retaining the fragments at the top of the main body. Preferably the retaining magnet is arranged outside the reception space in which the fragments are present. The retaining magnet is further preferably manufactured from a magnetic strip and/or a magnetic film and has preferably stronger and a weaker magnetized side. The stronger magnetized side can be assigned to the reception space or the topside of the container respectively.

Preferably the locking means is configured in a way that it clips audibly, if the cover adopts the close position.

The force of the retaining magnet is preferably selected in a way that the fragments do not rise, but are retained shiftably at the container.

Preferably the fragments are arranged along an axis inside the reception space or the top of the main body respectively. The retaining magnet can comprise one or more magnetic strips arranged adjacent to each other, each comprising a north pole and a south pole respectively. A north pole south pole connecting line of the magnetic strips is orientated parallel or along the axis inside the reception space respectively. The magnetic field is preferably orientated in a way that the magnetic field lines extend substantially parallel to the axis in a range in which the fragments are stored.

In order to ensure proper assignment of the retaining magnet relative to the reception space or the top of the main body respectively, an asymmetric cut-out for reception of the retaining magnet can be provided, wherein the retaining magnet comprises a corresponding adapted asymmetric contour. Other coding means can be used in order to achieve a proper alignment of the retaining magnet.

Preferably a stop surface is present at the top of the main body. The stop surface is preferably orientated rectangularly to a longitudinal direction. The fragments are aligned parallel to the longitudinal direction adjoining the stop surface at the top such that starting from the stop surface, the total length of the fragments and thus the presence of all fragments can be determined very easily.

It is further preferred, if at the top of the main body a depression is present that extends in longitudinal direction. The depression can be groove shaped or flume shaped. Preferably one length end of the depression directly adjoins the stop surface. The depression extends linearly along the axis for alignment of the fragments.

At the top of the main body, e.g. adjacent to the depression, a marking may be present by which the length of the fragments or the total lengths of all fragments can be determined very easily and quickly. This can be for example a scale with scale marks that can start directly at the stop surface and extends in length direction. Additionally or alternatively instead of the scale a respective marking for a particular needle can be present that, for example, represents the contour of the complete non-fractured needle and/or its length.

It is further preferred, if an identifier is present at the cover that contains additional information to the needle used for sewing and/or the sewing workplace, etc. preferably at least also in computer-readable form. For example the indicated information can contain a code that can be optically captured, such as a bar code or a QR-code or the like. Alternatively or additionally the information can be provided in another form than a form that can be optically captured, e.g. it can be stored on an RFID-chip at the container that is readable by a respective reading device. The reading device and the camera can form a part of a mobile device of the device. It is preferred, if the information is arranged in a way to be optically captured at the cover, such that they are within the imaging range of the camera during capturing the top of the main body, if the cover is in its open position. For example the information can be arranged at the inner side of the cover that is arranged opposite the top of the main body in the close position of the cover.

It is preferred, if the device has a processor unit that is connected with the camera and/or a display and/or an input unit. The processor unit and as an option the display or the input unit respectively can form a part of a mobile device. The display and the input unit can be formed by a common interface unit, e.g. a touch screen.

The mobile device can be a mobile phone or a hand-held computer, e.g. a so-called tablet computer.

Preferably the processor unit can be configured to transmit the captured image to a central computing unit. In the central computing unit the image can be stored for documentation purposes. Additionally or alternatively it is also possible to store the image in several independent storage devices and preferably at spatially separated storage locations independent from each other in order that subsequent manipulations at one of the images can be recognized. Together with the image, non-editable additional information can be stored, e.g. referring to the used needle and/or the sewing workplace at which the needle fracture has happened and/or the sewing person whom the needle broke and/or the textile part that was sewn when the needle fracture happened and/or the working person who examined and authorized the needle change and/or the date and/or the time. All information is linked and can be evaluated accordingly assisted by the processor unit.

The central computing unit can have a data base for stockkeeping and/or stock check, such that a number of available new needles, the needles that are actually in use or their use time so far is known. If necessary, the central computing unit can initiate order procedures for replacement purchase of particular needle types automatically or can remind a person of the replacement purchase.

The processor unit or the central computing unit can be configured to request or initiate the capture of the image automatically, e.g. if particular characteristic features are identified or recognized in the imaging range of the camera.

The processor unit or the central computing unit can be configured to check the sharpness of a captured image and to create a respective check result. If the sharpness of the image is not sufficiently good, the processor unit or the central computing unit can automatically request or initiate the capture of a further image. If a sufficiently sharp image is present, the release for continuation of the needle change can be issued or the correct documentation of the found fragments can be acknowledged respectively.

It is also advantageous, if the processor unit or the central computing unit is configured to prevent or delay the capture of an image until all of the fragments are present and the broken needle is completely reconstructed. This can be achieved by image evaluation algorithms that determine the complete reconstruction of the needle based on the fragments that are placed in the imaging range of the camera.

It is also advantageous, if the processor unit or the central computing unit is connected with a dispensing system of new needles and is configured to evaluate an identifier present at the cover and to transmit information about the new replacement needle to be dispensed to the dispensing system. Dispensing of non-fitting needles of another type can thus be prevented or at least the danger of a fault can be reduced. The dispensing system can block the dispensing of non-fitting needles of another type or can output a warning (e.g. optically and/or acoustically) in the event of an unintentional extraction of non-fitting needles of another type.

It is also advantageous, if the processor unit or the central computing unit is configured to represent the captured image and additional information that describes target geometry of the non-broken needle on the display. For example the contour and/or a three-dimensional illustration of a non-broken needle can be displayed around the fragment in the captured image, such that it can be directly recognized whether all of the fragments have been found or whether parts of the needle are missing. The target geometry can be represented as contour line. Alternatively or additionally selected geometric values, e.g. a length of the non-broken needle or similar can be displayed.

It is advantageous, if the processor unit or the central computing unit is configured to create an evaluation result that indicates whether all of the fragments are present in the captured image or not. This can be checked, e.g. by an image evaluation method and can be output as evaluation result. In one embodiment the total length of the abutting fragments in the captured image is compared with the length of the non-broken needle during this evaluation. If the total length of the captured fragments is equal to the initial length of the non-broken needle, it can be indicated as an evaluation result that all of the fragments are present. If the total length of the abutting fragments is shorter than the length of the non-broken needle, it can be indicated that fragments of the broken needle are missing. Additionally or alternatively to the evaluation of the length the contour of the separate fragments and/or the contour of the abutting fragments can be compared with a target geometry or target contour of the needle. Additionally the possibility exists to determine features of the fracture surface by an image evaluation method and to evaluate whether two fraction surfaces of two fragments belong to the same fraction location. In doing so, it can also be determined whether all of the fragments of the needle are present.

By concurrently capturing and/or scanning of a section of the needle, e.g. at the shank of the needle, a digital "footprint" of the needle can be created based on the surface of the needle, under the condition that the resolution of the image and the sharpness are sufficiently good. In doing so, a mark at the shank of the needle, such as a manufacturer and/or needle type indication (stamp) can be used as a position mark for example. In doing so, it can be unambiguously identified which needle has been initially output at the work station and returns. Alternatively, this can also be carried out by capturing and/or scanning of a bar code at the needle. When using the same technology during the manufacturing of the needle, in this way retracing and/or documenting of the whole life cycle of the needle can be achieved.

Additionally to the camera further capturing devices can be present, e.g. a scan device, particularly a 3D-scan device.

With such additional scan devices additional features of the fragments can be captured and evaluated.

In the central computing unit and/or the processor unit information about the used needles or needle types can be stored in a database, particularly the length and/or contour and/or other dimensions of a needle or a needle type. These data are thus available for the evaluation. For example the data can be linked automatically with the captured image when the captured image is assigned with a needle or a needle type, e.g. by a code in the captured image itself that can be optically captured.

It is preferred, if all of the determined data and/or information are connected or linked with the respective manufacturing order in the sewing plant.

It is advantageous, if all of the determined data and/or information are connected or linked with the respective manufacturing order of the sewing plant and within the manufacturing order with the sub-ordered bundle number or part number respectively.

It is advantageous, if all of the determined data and/or information are evaluated by a pre-determined evaluation strategy along the value chain and the respective manufacturing order of the sewing plant.

The evaluation and/or the access on the data and/or information are performed preferably by usual browser software.

A carriage moveable by a user may belong to the device wherein in or at the carriage the camera or the mobile device with the camera or the processor unit or the display or the input unit may be arranged respectively.

For example, at the carriage tools for finding of fragments can be arranged, like a tool with a magnetic end that can also be referenced as magnet broom.

Preferably the carriage comprises an energy source for operating the camera or the mobile device respectively. The carriage can also comprise a transmit and/or receipt device that may be connected with the camera and/or the mobile device and particularly the processor unit in order to establish a communication connection with the central computing unit and/or with the at least one storage unit.

The carriage can comprise at least three drawers that are moveable between two positions.

The carriage has preferably weight distribution and a fixing mechanism in order to prevent tipping of the carriage and thus dislocation of the content of the different storing sections of the carriage.

The carriage can comprise sections that are separated from each other for storing of new non-used needles and used needles. In doing so, the carriage is designed in a way that only one of the two sections is accessible. For example, it can be prevented that during opening of the section with new needles, the section with used needles can also be opened. The carriage can also comprise four sections separated from each other such that new unused needles, broken non-documented needles, used and non-broken non-documented needles as well as broken/used documented needles can be stored separated from each other.

A deposit opening is preferably present at the carriage for depositing fragments of a broken needle in a collection container that may be arranged releasably in the carriage. A counting device can be assigned to the deposit opening that counts the deposited fragments. The counting device can be connected with transmission and/or display means that displays the counted fragments and/or transmits the counted fragments to the mobile device. The counting device can comprise a light barrier at the deposit opening.

Preferably the mobile device is connected or connectable also with a digital unit (processor/computer) of the sewing machine in a wireless or wired manner. In doing so, a data exchange is facilitated. Data like the total operation time of a currently used needle can be determined and therefrom a needle exchange date can be calculated in order to execute a needle change before a needle fracture.

Preferably a mobile device arranged at the carriage is wirelessly connected by the central computing unit or by a local network, wherein the mobile device is configured to display an alarm initiated from a sewing person at a sewing workplace in the event of a needle fracture and to preferably output the location of the sewing workplace.

A mobile apparatus can be arranged in the carriage, e.g. in a suitcase. If the carriage is still on duty and a further needle fracture occurs, the mobile apparatus can be used that can also contain a camera or a mobile device with a camera and a container and replacement needles as an option.

BRIEF DESCRIPTION OF THE DRAWINGS

Preferred configurations of the device and the method can be inferred from the dependent claims, the description and the drawings. Hereinafter preferred embodiments of the invention are explained in detail with reference to the attached drawings. They show in FIG. 1 a schematic top view of the container of FIG. 1 with view on the top of the main body and on the inner side of the cover in the open position of the cover, FIG. 2 a schematic top view of the bottom of a main body of a container as well as an insert that can be releasably attached at the main body, FIG. 3 a schematic illustration of fragments of a broken needle as well as the container of FIG. 2 in a side view, FIG. 4 a schematic illustration of the capturing of an image of the fragments of a broken needle that are arranged in the container, FIG. 5 a schematic illustration of the side view of the container, wherein the cover is in its close position, FIG. 6 a schematic block-diagram-like illustration of a mobile device that comprises a camera for capturing an image that is in communication connection with a central computing unit and FIG. 7 a schematic perspective illustration of a carriage with a mount for the mobile device of FIG. 6 and FIGS. 8*a*-8*e* a schematic illustration of a method for handling fragments of a broken needle.

DETAILED DESCRIPTION

Figure 1:
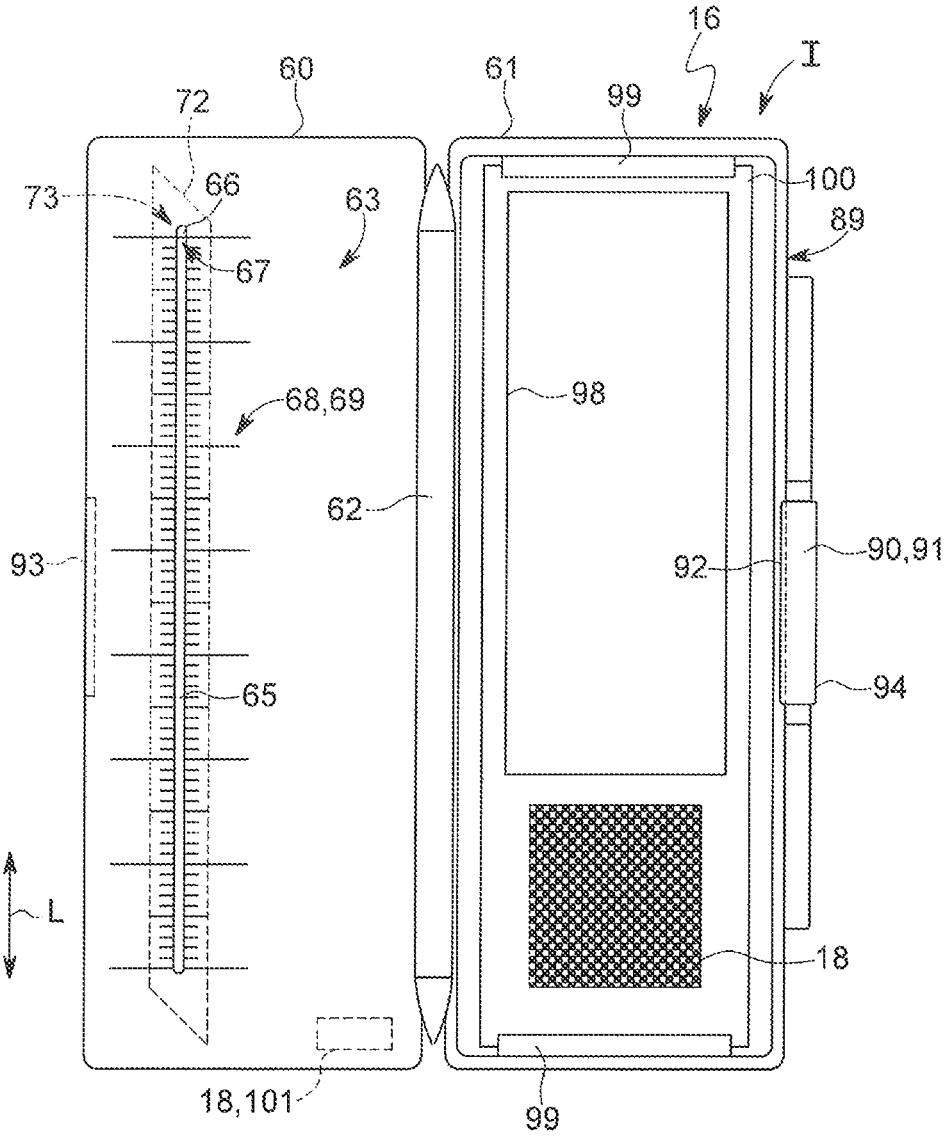
Figure 2:
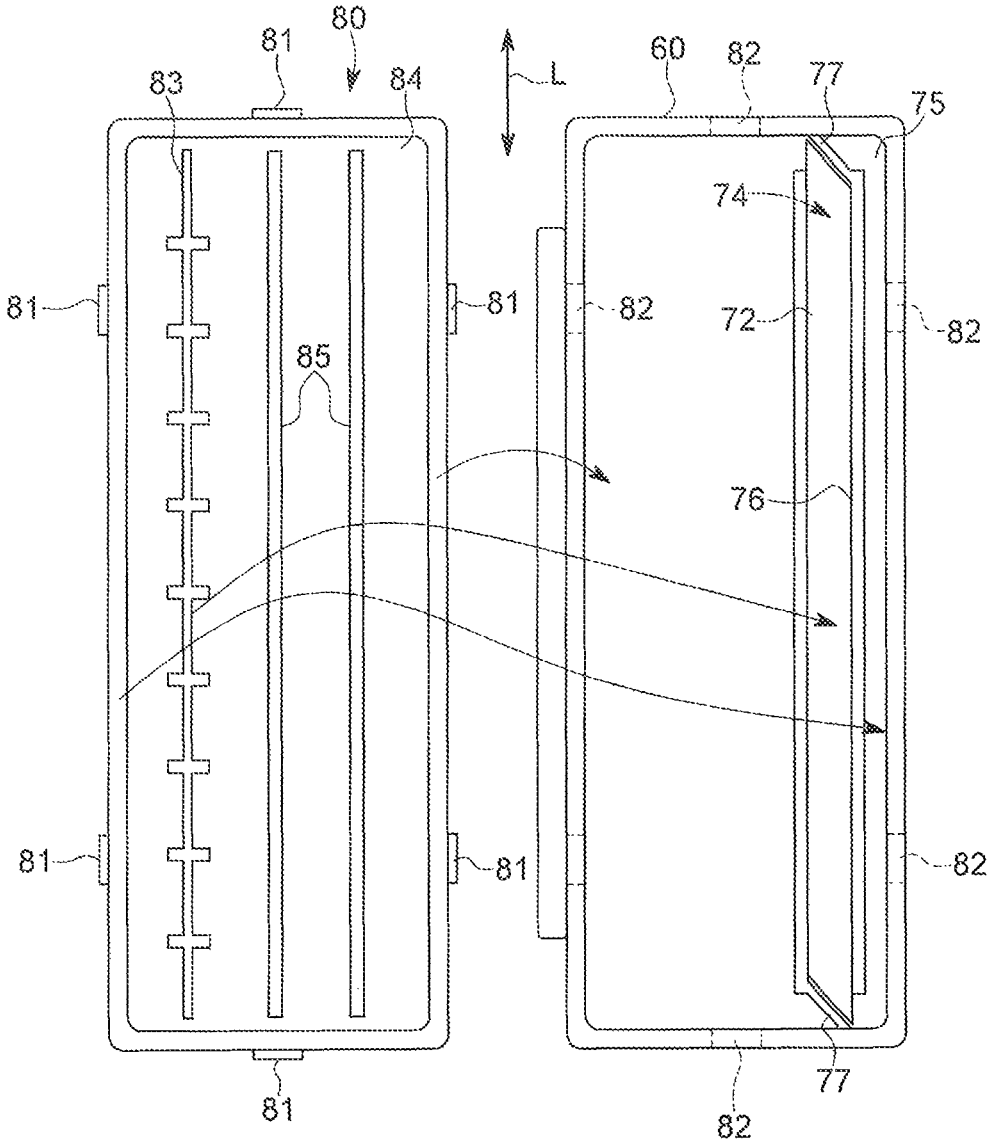

During sewing of textile parts, e.g. clothes, great care must be taken in the event that a needle breaks during sewing. The fragments 10 of the broken needle 11 must not remain in the textile part. It is thus important to document whether all of the fragments 10 of a broken needle have been found. In FIGS. 8*a*-8*e* a method is schematically illustrated during which in the event of a needle fracture at a sewing workplace 15 the fragments are received in a container 16, the receipt of the fragments 10 is documented and a new needle 17 is provided for the sewing workplace 15.

Figure 6:
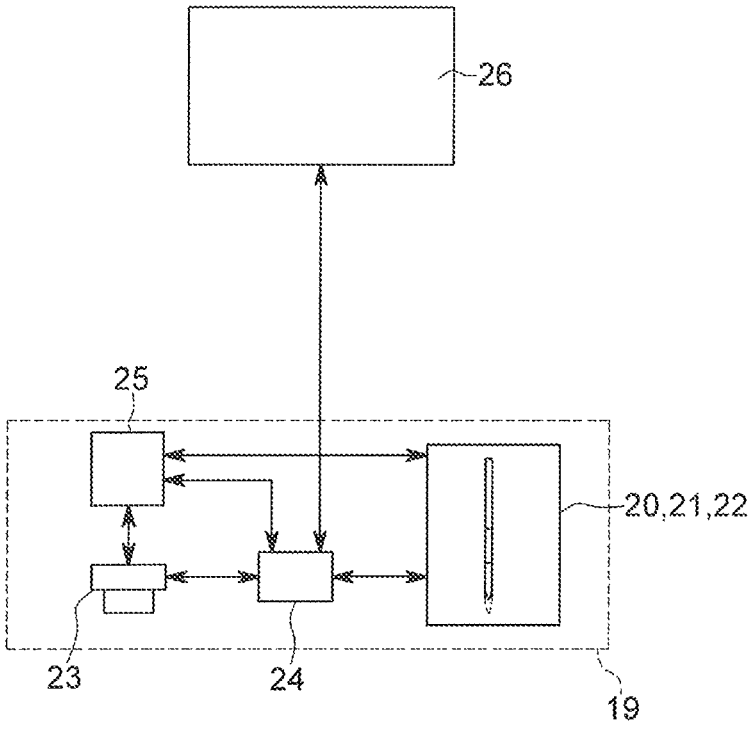

According to the example, an unambiguously identifiable container 16 is assigned to each sewing workplace 15. In doing so, at the container 16 a respective identifier 18 can be present. In the embodiment the identifier 18 is embodied as optically detectable identifier, e.g. by a bar code or a QR-code and arranged at the container 16. Alternatively, the identifier can be an RFID-chip or another form of identifier that is detectable by detecting means of a mobile device 19. According to the example, a hand-held computer, particularly a so-called tablet computer or alternatively a smartphone or the like is used as mobile device 19. The mobile device 19 has, according to the example, a touchscreen 20 that serves as display 21 for outputting information and also as input unit 22. The mobile device 19 further comprises a camera 23, a processor unit 24 and a storage unit 25 (FIG. 6). The mobile device 19 further has suitable communication means by which a wired and preferably a wireless connection to a network or an external central computing unit 26 can be established.

The mobile device 19 and the container 16 can be arranged at a preferable moveable carriage 30 that is used by a supervisor in the event of a needle fracture at a sewing workplace 15. The data and images collected by the mobile device 19 by the supervisor can preferably be assigned to the supervisor, e.g. by login of the supervisor at the mobile device 19.

Figure 8A:
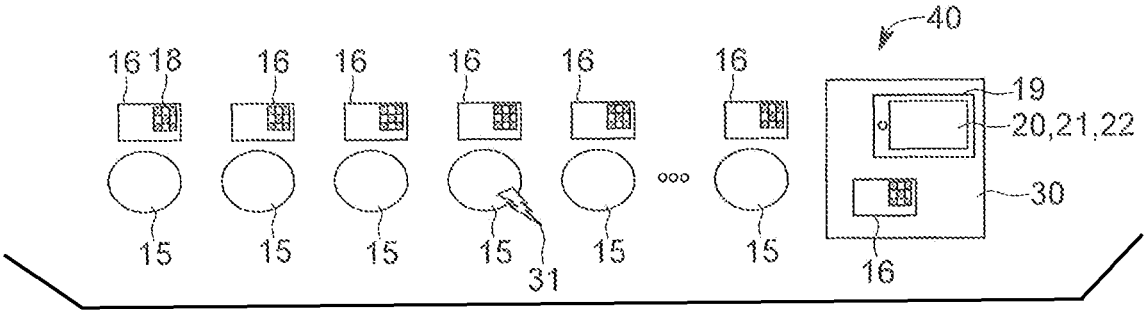
Figure 8B:
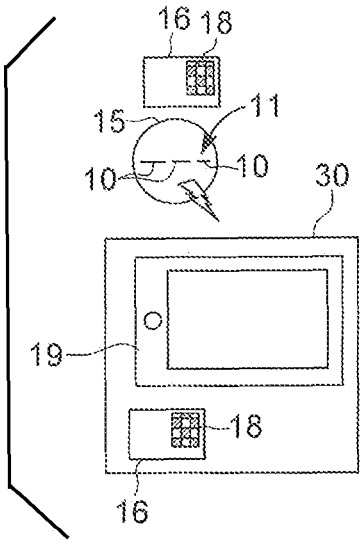

At the sewing workplace 15 itself no replacement needles are present. The replacing of a damaged or broken needle 11 is performed following a fixed predefined method. It is assumed that at one of the sewing workplaces 15 the sewing needle breaks and the sewing person indicates the needle fracture. This can happen for example by initiating an alarm 31 that can be received and displayed from a receiver at the carriage 30 or in the mobile device 19 respectively (FIG. 8*a*). In doing so, the sewing workplace 15 can be identified at which the needle fracture has happened. The supervisor can thus visit the respective sewing workplace 15 with the carriage 30 (FIG. 8*b*).

Figure 8C:
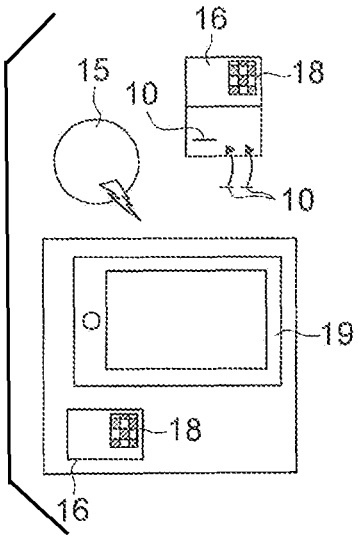

If the sewing workplace 15 is reached, the fragments 10 of the broken needle 11 are collected and are inserted in a predefined position in the container 16 assigned to the sewing workplace 15. Preferably all of the fragments 10 are arranged directly adjoining each other along a common axis in a longitudinal direction and the initial needle shape is reconstructed so to say (FIG. 8*c*).

Figure 8D:
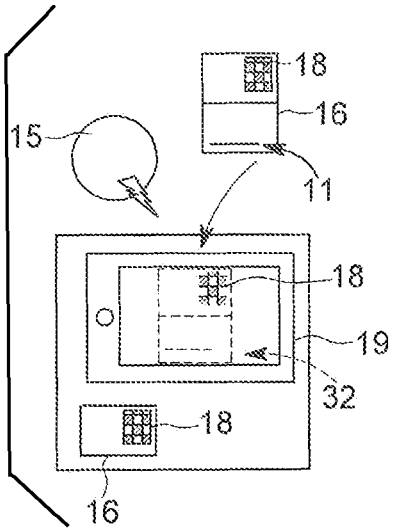

The container 16 assigned to the sewing workplace 15 is placed with the inserted broken needle 11 and its identifier 18 in the imaging range of the camera 23 of the mobile device 19 and an image 32 of the fragments 10 of the broken needle 11 is captured (FIG. 8*d*). According to the example, in doing so, the identifier 18 of the container 16 is captured in the image 32. According to the example, the identifier 18 is a two-dimensional code, particularly a QR-code. This code indicates the sewing workplace 15 to which container 16 or the broken needle 11 contained therein belongs. Additionally to the identifier 18 text information in a text field at the container 16 can also be present that is captured in the image 32. Additionally, the surface and/or the shank stamp (marking at the shank of the needle) of the needle can be used as needle-related information.

It is also possible to link the image 32 with additional information, as for example information relating to the used needle type and/or a sewing person that works at the sewing workplace 15 with the needle fracture. For example, personal identification data of a plant ID-card can be captured and linked with the image 32. Additionally or optionally, it is also possible to identify the textile part manufactured at the point of time of the needle fracture at the sewing workplace 15 and to store respective identification data linked with the image 32.

All of the information assigned with the image 32 can be stored or archived respectively in a single file together with the image 32. The file is preferably not editable. Further the possibility exists that the file is stored at several storing locations independent from each other in order to be able to detect subsequent modifications at one of the files. The access to the archived files can be limited to a group of persons. Thus, the danger of manipulation of a file is reduced or precluded. The data or images captured by the mobile device are preferably stored in the mobile device 19 at least until transmission of the data or images respectively to a remote storage unit and/or computing unit 26 has been carried out.

Preferably an evaluation performed in the mobile device 19 whether the captured image has a sufficient sharpness. This can happen by corresponding image processing routines. Such a check can also be performed in the central computing unit 26, to which the image 32 is transmitted. If it results that the image is not sharp, the supervisor is requested to capture another image with the camera 23 or the mobile device 19 automatically controls the camera 23 in order to capture a further image 32. As soon as the image 32 has sufficient sharpness it can be indicated to the supervisor, who performs the replacement of the needles, that the replacement procedure can be continued.

Figure 8E:
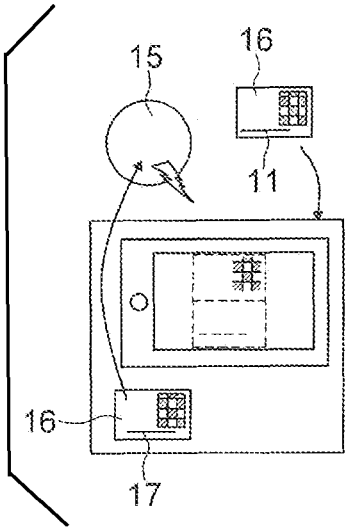

Subsequently the container 16 with the broken needle 11 is closed and arranged in the carriage 30. For the sewing workplace 15 a new needle 17 is provided in another container 16 and handed out for continuation of the work. If the containers 16 contain an identifier 18 that is fixedly assigned to the workplace 15, the container with the new needle 17 has the same identifier 18. In the case of a dynamic assignment, the identifier 18 of container 16 with the new needle 17 is captured by the mobile device 19 and is assigned to the sewing workplace 15 (FIG. 8*e*).

In a preferred embodiment one RFID-chip can be present in each container 16. The container 16 can then be checked in the sewing workplace 15 or checked out of the sewing workplace 15. Doing so, the identifier is connected or linked with the RFID-chip by the assignment to the workplace.

Thus, the needle replacement of the broken needle 11 by a new needle 11 is completed and the supervisor with the carriage 30 leaves the sewing workplace 15 again. The supervisor can execute this procedure without reading and/or without speaking and/or without writing by operating the functions (of an App) of the mobile device.

Figure 7:
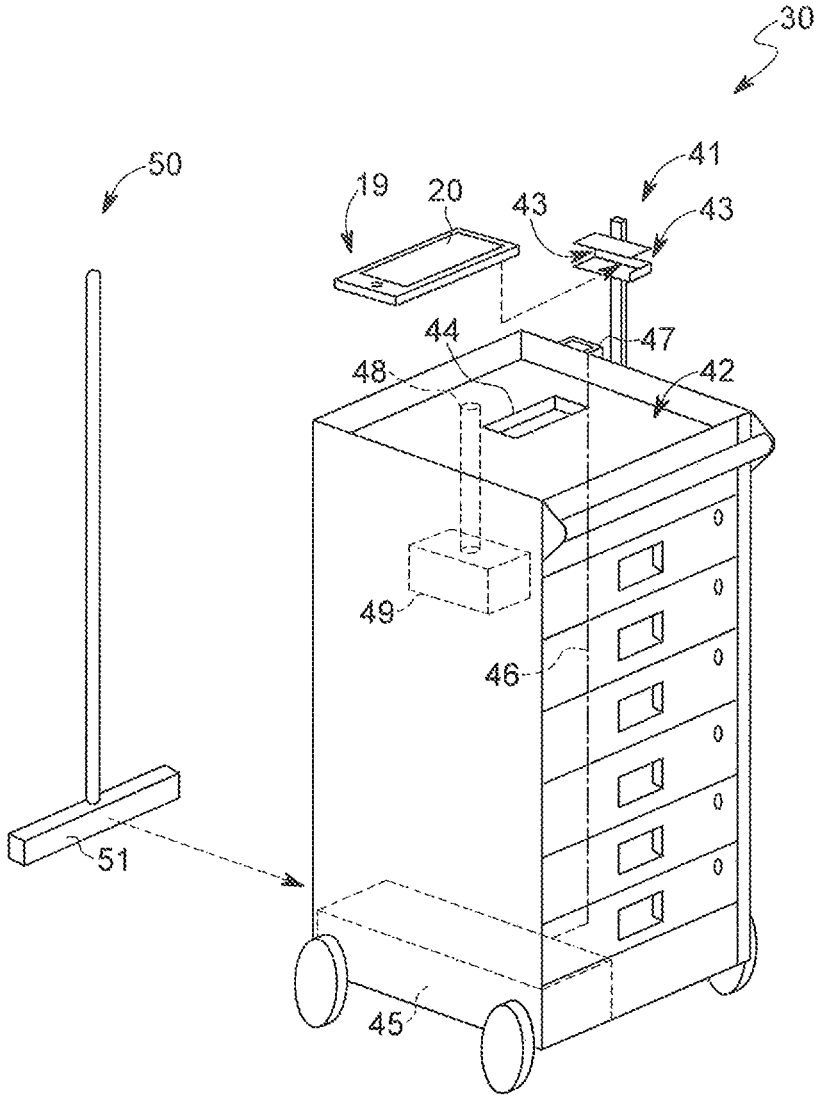

FIG. 7 illustrates an embodiment of the carriage 30 of a device 40 that can be used for executing the above-described method. According to the example, the carriage 30 comprises mount 41 for the mobile device 19. According to the example, mount 41 is adjustable and can be shifted and/or tilted relative to a working surface 42. Particularly, the mount 41 can be shifted in a vertical direction in order to increase or decrease the distance to the working surface 42. As an option mount 41 can also be tilted about a pivot axis that extends parallel to the working surface 42.

In FIG. 7 the mount 41 is illustrated only as an example and highly schematically. It can be configured to hold the mobile device 19 by form-fit and/or force-fit and can be adapted to the used form of the mobile device 19. Preferably the mount has one or more stop surfaces 43 that predefine the position of the mobile device 19 at least in the space directions parallel to the working surface 42.

At the working surface 42 a positioning means 44 can be present in order to position the container 16 in the viewing area of the camera 23 at the working surface 42 during the capture of the image 32. For example, the positioning means 44 can be formed by a depression (FIG. 7) by at least one protrusion or by another suitable means that define the position of the container 16 on the working surface 42. In the simplest case the positioning means can define the position of the container 16 for the capture of the image 32 by an optical mark.

The carriage 30 comprises an energy storage also, e.g. a rechargeable battery 45. Preferably the battery 45 is arranged in the carriage 30 as low as possible in order to lower its center of gravity. The battery 45 is connected with a connector 47 at the outside of the carriage 30 by means of a line 46. Via the connector 47 and a respective cable, the mobile device 19 can be connected with the battery 45 for the supply of current. The battery 45 and/or the carriage 30 can be corrected with a socket (grid connection) by a cable in order to load the battery 45 and/or to supply additional electrical devices or consumers for example. An additional electrical device can be a light source for the capture of the image or also a receiver for an alarm system for example. The receiver of the alarm system can contain, e.g. mono-board computer, like a computer of the type "Rasperry Pi".

The carriage 30 has a deposit opening 48 at the working surface 42 that is connected with a collection container 49, e.g. via a shut. The collection container 49 can be arranged in one of the drawers of the carriage 30 for example. After the image 32 has been captured and stored for documentation purposes, the fragments 10 of the broken needle 11 that are present in the container 16 can be removed from the container 16 outside the sewing workplace 15 and deposited in the collection container 49 via the deposit opening 48.

The carriage 30 can also comprise several deposit openings 48 in one embodiment, e.g. one deposit opening 48 for the broken and another deposit opening 48 for non-broken damaged needles. At the deposit opening 48 a depression for the container 16 can be present, in which the opened container 16 can be inserted in a way that the fragments 10 of the broken needle 11 are arranged above the deposit opening 48 by a retaining magnet 72 of the container 16 and can be shifted or deposited respectively very easily downward into the deposit opening 48.

The collection container 49 can be detachably arranged at the carriage 30. A signal can indicate whether a collection container 49 is present in the carriage or not and/or whether the collection container 49 is open.

At the carriage 30 a tool 50 with a magnetic end 51 can be carried also. The holder at the carriage 30 for the tool 50 is preferably from a non-magnetizable material and can consist, e.g. from aluminum. By means of the tool 50 the fragments 10 of the broken needle can be captured and collected at the sewing workplace 15, particularly if some of the fragments 10 have fallen on the floor. The magnetizable end 51 can be arranged such that it is moved close to or with contact to the ground during movement of the carriage 30 in order to collect metallic parts, e.g. fragments 10. For this the magnetizable end 51 is preferably arranged at the carriage 30 in a height-adjustable manner.

Figure 9:
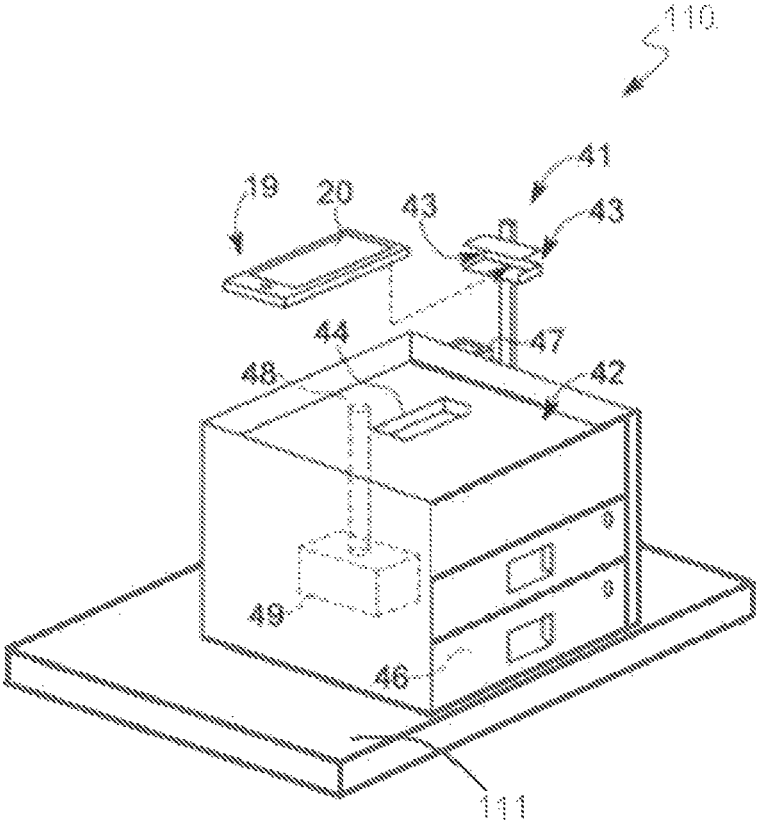
FIG. 9 is a perspective view of a stationary unit in accordance with various embodiments.

Additionally or alternatively to the mobile carriage 30, the device 40 can also contain a stationary unit, e.g. a table unit 110 (FIG. 9). The table unit 110 can be deployed onto a tabletop 111, e.g. on the tabletop of a sewing workplace 15. Construction height of the table unit 110 is, for example, selected in a way that the table unit 110 forms a standing workplace when it is deployed on a tabletop 111. The table unit 110 can have particularly the same configuration as the carriage 30, such that reference can be made to the description above. The table unit 110 comprises also the working surface 42, the collection container 49 and the deposit opening 48. The table unit 110 can also contain particularly the camera 23, the processor unit 24, the storage unit 25 and an energy storage. Different to the carriage 30, the wheels and the tool 50 are omitted at the table unit. For the needle replacement the broken needles can be brought to the table unit 110 that preferably remains at one location.

The device 40 comprises at least one container 16 and a camera 23 that form part of the mobile device 19 in the embodiment. As explained above, according to the example also a carriage 30 is used that can be completed or replaced also by a suitcase or another mobile unit. Based on the FIGS. 1-5 an embodiment of the container 16 is hereinafter explained in detail.

According to the example, the container 16 has a main body 60 and a cover 61. The cover 61 is supported pivotably between an opened position I and a close position II at the main body 60 by a hinged joint 62. In the close position II the topside 63 of the main body 60 and the cover 61 limit a reception space 64 that is completely closed in the close position II. The reception space 64 is configured to receive the fragments 10 of the broken needle 11.

Figure 3:
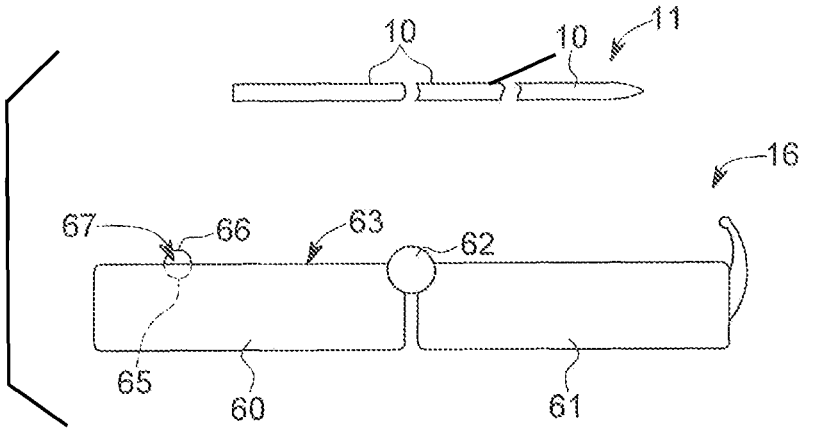
Figure 4:
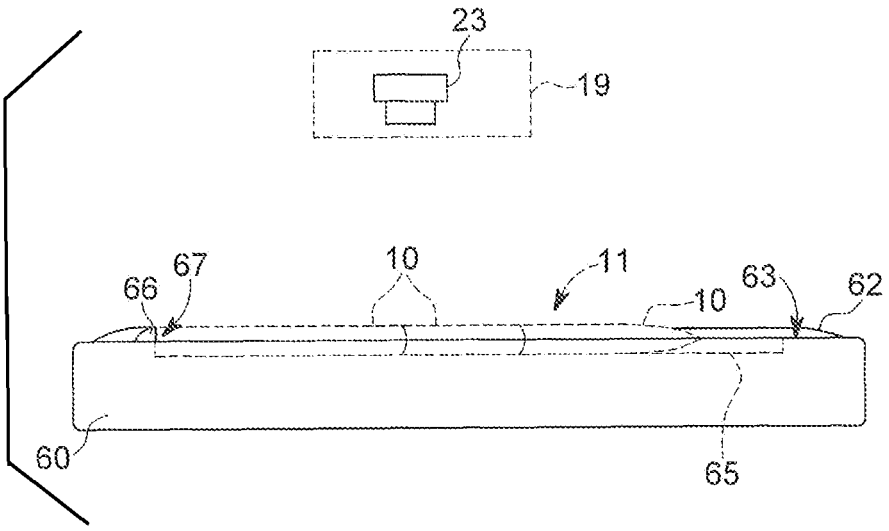
Figure 5:
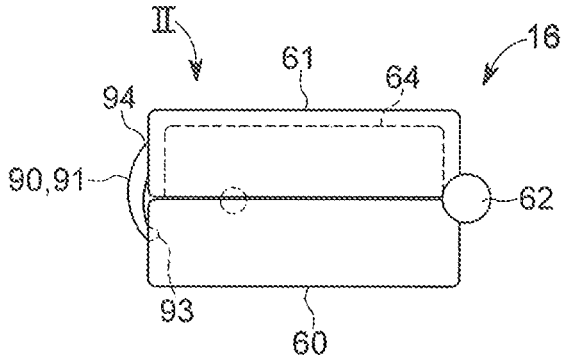

At the topside 63 of the main body 60 a depression 65 is present that extends in a length direction L. The depression 65 has the shape of a flume according to the embodiment. At one length end the depression 65 adjoins a stop 66 with a stop surface 67. The stop surface 67 extends within a groove and outside the groove above the topside 63 according to the embodiment. The stop surface 67 is orientated at a right angle to the length direction L according to the example. The stop surface 67 can have a circular shape in the embodiment. Cross-section of the depression 65 can be semi-circular shaped (FIG. 3).

One of the two length ends and here the length end of the depression 65 opposite the stop 66 transitions steplessly in the topside 63 in order to facilitate a shifting out of the needle fragments without an obstacle.

Adjacent to the depression 65 marking 68 and according to the example a scale 69 is present at the topside 63. Starting from a reference point that is here formed by the stop surface 67, the scale 69 marks the length of fragments 10 or the total length of all fragments 10 of the broken needle 11 that abut each other arranged in the depression 65. By means of the scale 69 it can be quickly recognized whether the total length of the found fragments 10 correspond to the total length of the initial needle such that it can be recognized whether all of the fragments 10 are present. The scale 69 can comprise marks in regular distances in length direction L, as illustrated in FIG. 1. Additionally or alternatively, individual marks or other markings 68 for the length of the used needle types can be present.

The fragments 10 of a broken needle 11 are preferably arranged in the depression 65 starting with the needle shank at the stop surface 67 abutting each other. The needle tip is farthest away from the stop surface 67 in the depression 65 and marks the total length of all of the arranged fragments 10.

For retaining the fragments 10 inside the depression 65, the container 16 comprises a retaining magnet 72. The retaining magnet 72 creates a magnetic field in the range of the depression 65 or the topside 63 respectively in order to retain the fragments 10 for a capture of the image 32. The magnetic field is, however, sufficiently weak that a rising of the individual fragments 10 is avoided.

According to the example, the retaining magnet 72 is manufactured by a magnetic film or a magnetic strip that extends in length direction L. The retaining magnet 72 comprises a topside 73 facing the reception space 62 or the depression 65 respectively and an opposite bottom side 74. The topside 73 of the retaining magnet 72 is stronger magnetic than the lower side 74. At the lower side 74 a non-magnetic carrier layer can be present, for example that carries a magnetic layer. The retaining magnet 72 or its magnetic layer consists of one or more magnetic strips, each comprising a north pole N and a south pole S. A connecting line between the north pole N and the south pole S of each magnetic strip is orientated parallel to the length direction according to the example.

For receipt of the retaining magnet 72 the main body 60 has an inner region 75 with a reception cutout 76 below the topside 63. The reception cutout 76 extends in length direction L and its width transverse to the length direction L corresponds to the width of the retaining magnet 72.

It is important to attach the retaining magnet 72 at the main body 60 in its correct orientation with the topside 73 facing the reception space 64. At both ends in the length direction the reception cutout 76 is formed unsymmetrically with reference to a mid-plane extending in length direction L. According to the example, a respective border wall 77 of the reception cutout 76 extends under an angle non-equal to 90° relative to the length direction L. The reception cutout 76 thus has the shape of a parallelogram with two parallel length sides in length direction L and two parallel limit walls 77 at the length ends that are non-rectangularly orientated with reference to the length direction L. The retaining magnet 72 has an outer contour adapted thereto corresponding to a non-rectangular parallelogram. In doing so, it is achieved that an unintentional confusion of the topside 73 and the bottom side 74 of the retaining magnet is prevented during insertion into the reception cutout 76.

The reception cutout 76 is open at the bottom side opposite to the topside 63 of the main body 60 and the retaining magnet 72 can be inserted into the reception cutout 76 from the open side. In order to secure the retaining magnet 72, the container 16 comprises an insert 80 according to the example that is releasably insertable in the inner region 75 of the main body 60 and is retained there by force-fit and/or form-fit. According to the example, the insert has at least one latch protrusion 81 at opposite sides, wherein a respective latch cutout 82, at least open to the inner region 75 at the main body 60, is assigned to each latch protrusion 81. The insert 80 can be inserted in the inner region 75 and can be latched after insertion of the retaining magnet 72 in the reception cutout 76. In doing so, the retaining magnet 72 is retained in the reception cutout 76 directly adjacent to the depression 65.

For supporting the retaining magnet 72 the insert 80 can comprise one or more support protrusions 83 that abut at the bottom side 74 of the retaining magnet 72 and support it in the desired position when a latch connection between the insert 80 and the main body 60 is established. In the embodiment the support protrusion 83 is formed by a plurality of support ribs that are connected with each other and arranged in a cross shape. The at least one support protrusion 83 protrudes upward from a bottom 84 of the insert. From the bottom 84 additional ribs 85 for stabilization can protrude as well.

At an edge outer side 89 opposite the hinged joint 62 rectangular to the length direction L the cover 61 has a locking means 91 that is configured as latching means 90 according to the example. The locking means 91 is configured to retain the cover 61 in its close position II and to prevent an unintentional opening or suspending of the close position II.

According to the example, the latching means 90 have a latch nose 92 that interferes in a latch depression 93 in the close position II. The latch nose 92 is arranged at a free end of an elastically moveable biasing element 94 that extends from the edge outer side 89 substantially at a right angle with reference to the length direction L and elastically supports the latch nose 92 about a pivot axis that extends approximately parallel to the length direction L in the range of the outer side 89. In the open position I the latch nose 92 extends from the biasing element 94 in a way that it protrudes in the structure clearance of the cover 61 (FIG. 1). The latch depression is present at the main body 60 at a side area opposite to the hinged joint 62.

FIG. 1 also illustrates the possibility, how an identifier 18 can be arranged at the container 16. In the embodiment the identifier 18 is attached to the inner side of the cover 61 in the form of a two-dimensional areal optically detectable code, such as a QR-code, wherein the inner side of the cover 61 lies adjacent to the topside 63 of the main body 60 in the open position I and faces the camera 23. The identifier 18 can thus be captured by the image 32 and the information contained in the identifier can be read. The inner side of the cover 60 additionally to the identifier 18 a text field 98 can also be present that can comprise information in form of readable letters and/or numerals. The identifier 18 and the text field 98 can be on paper or another carrier replaceably retained at the inner side of the cover 61. According to the example at the two opposite sides in length direction L, retaining legs 99 are present that overlap a carrier 100 at the periphery and retain it at the inner side of the cover 61. On the carrier 100 the optically detectable identifier 18 and optionally a text field 98 are present.

The processor unit of the mobile device 19 can be configured to initiate the capture of the image 32 automatically, e.g. if particular characteristic features are recognized or identified in the imaging range of the camera, such as the opened container 16 and/or the marking 68 and/or the identifier 18 and/or the fragments 10. The automatic triggering of an image can be performed, for example, if marking on the needle shank is sharply captured by the camera, such as if a shank stamp is imaged readably.

Another possibility is to attach the identifier 18 in the form of an RFID-chip 101 at or in the container 16. The mobile device 19 can contain respective reading means in order to contactlessly read the data on the RFID-chip 101.

In the present embodiment the retaining magnet 72 has a thickness of about 1.5 mm and a width, rectangular to the length direction L between 3.5 mm and 4 mm and a length in length direction L of about 70-80 mm. The maximum energy product is preferably in a range of about 6 $kJ/m^3$ to 18 $kJ/m^3$ and preferably at at least 9 $kJ/m^3$. The residual magnetism is preferably in a range of about 150 mT to about 440 mT and preferably at at least 220 mT. The coercive field strength of the magnetic flux density HcB is in the range of about 100 kA/m to about 240 kA/m and preferably at at least 170 kA/m. The coercive field strength of the magnetic polarization HcJ is preferably in a range of about 190 kA/m to about 560 kA/m and preferably at at least 280 kA/m.

The invention refers to a device 40 and a method for handling of fragments 10 of a broken needle 11, e.g. in the context of a needle replacement of a broken needle 11 with a new needle 17. The fragments 10 of the broken needle 11 are arranged in a container 16 and a predefined position. Subsequently an image 32 of the fragments 10 of the broken needle 11 is captured by means of a camera 23. The captured image 32 is stored at least at one storing location and/or evaluated that effect whether all of the fragments 10 of the broken needle 11 are present for documentation. After the capture of the image 32 the container 16 is closed in order to avoid loss of the fragments 10 of the needle 11 away from the sewing workplace.

The capture of the image 32 can be used for control of the logistics during the needle replacement. Particularly additional information to the broken needle 11 and/or to a sewing work station can be captured and evaluated and/or used for production or logistics control by and/or with the capture of the image 32 also.

REFERENCE LIST

10 fragment
11 broken needle
15 sewing workplace
16 container
17 new needle
18 identifier
19 mobile device
20 touchscreen
21 display
22 input unit
23 camera
24 processor unit
25 storage unit
26 central computing unit
30 carriage
31 alarm
32 image
40 device
41 mount
42 working surface
43 stop surface
44 positioning means
45 battery
46 line
47 connector
48 deposit opening
49 collection container
50 tool
51 magnetic end
60 main body
61 cover
62 hinged joint
63 topside of the main body
64 reception space
65 depression
66 stop surface
67 stop surface
68 marking
69 scale
72 retaining magnet
73 topside of the retaining magnet
74 bottom side of the retaining magnet
75 inner region of the main body
76 reception cutout
77 border wall
80 insert
81 latch protrusion
82 latch cutout
83 support protrusion
84 bottom
85 rib
89 edge outer side
90 latching means
91 locking means
92 latch nose
93 latch depression
94 biasing element
98 text field
99 retaining leg
100 carrier
101 RFID-chip
110 table unit
111 tabletop
I open position
II close position
L longitudinal direction
N north pole
S south pole

The invention claimed is:

1. A method for handling of fragments (10) of a broken needle (11), the method comprising:

arranging the fragments (10) of the broken needle (11) in a container (16) in a predefined position, utilizing a camera (23) to capture an image (32) of the fragments (10) of the broken needle (11) while the fragments (10) are arranged in the container (16) in the predefined position, storing of the captured image (32) for one or both of documentation and evaluating the image (32) for checking whether all of the fragments (10) of the broken needle (11) are present, associating information related to the broken needle with a respective manufacturing order.

2. The method according to claim 1, further comprising assigning the container (16) to a sewing workplace (15).

3. The method according to claim 2, further comprising in response to a needle fracture at the sewing workplace, identifying one or both of the sewing workplace and an operator of the sewing workplace.

4. The method according to claim 1, further comprising in response to a needle fracture, identifying a textile part manufactured with the broken needle.

5. The method according to claim 1, wherein the container with the fragments (10) is exchanged with another container (16) with a new needle.

6. The method according to claim 1, further comprising transmitting the captured image (32) to a central computing unit (26).

7. The method according to claim 6, further comprising transmitting further data related to one or any combination of the broken needle, a sewing workplace, and an operator of the sewing workplace together with the captured image.

8. The method according to claim 1, further comprising executing an automatic evaluation, based on the captured image, of whether all of the fragments of the needle are present.

9. The method according to claim 1, further comprising associating information related to the broken needle with a respective manufacturing order of and within the manufacturing order with a sub-ordered bundle number or part number.

10. The method according to claim 1, further comprising evaluating information related to the broken needle by a predefined evaluation strategy along a value chain and respective manufacturing order.

11. The method according to claim 1, wherein the storing of the captured image (32) comprises storing the captured image (32) at spatially separate locations.

12. The method according to claim 1, further comprising linking the captured image (32) with additional information other than the captured image itself.

13. The method according to claim 12, further comprising storing the captured image (32) and the additional information in a single file.

14. The method according to claim 13, wherein the storing the captured image (32) and the additional information in a single file comprises storing the captured image (32) and the additional information in a single, not editable file.

15. The method according to claim 12, wherein the additional information consists of used needle type, identification data of a sewing person, identification of a textile part manufactured at a point of needle fracture, and combinations thereof.

16. The method according to claim 1, further comprising using a mobile device (19) to capture the image (32), the mobile device (19) comprising the camera (23), a processing unit (24), and storage (25).

17. The method according to claim 1, wherein the arranging the fragments comprises arranging the fragments using a retaining magnet (72) arranged outside a reception space (64) at a main body (60) of the container (16).

18. The method according to claim 1, wherein the arranging the fragments comprises arranging the fragments adjoining a stop surface (67) present at a topside (63) of a main body (60) of the container (16).

19. The method according to claim 1, wherein the arranging the fragments comprises arranging the fragments in a depression (65) extending in a length direction (L) and provided directly above a retaining magnet (72) at a topside (63) of a main body (60) of the container (16).

20. The method according to claim 1, wherein the arranging the fragments comprises arranging the fragments relative to a marking (68) arranged at a topside (63) of a main body (60) of the container (16).

21. The method according to claim 1, wherein the capturing of the image (32) further comprises capturing one or both of information and production data of the broken needle during the capturing of the image (32).

22. The method according to claim 1, further comprising testing a sharpness of the image with a processer unit (24) or central computing unit (26) and to create a respective test result.

23. The method according to claim 1, further comprising displaying the captured image and information describing a target geometry of the needle prior to breaking on a display (21).

24. The method according to claim 1, further comprising using a processer unit (24) or central computing unit (26) to create an evaluation result that indicates whether all of the fragments (10) are present in the captured image or not.

25. The method according to claim 24, further comprising during the creating the evaluation result, comparing the fragments (10) abutting each other with a length of the needle prior to breaking.

26. The method according to claim 24, further comprising using the processor unit (24) or the central computing unit (26) to one or both of compare contours of the fragments (10) and compare a contour of the fragments (10) abutting each other with a target geometry of the needle prior to breaking.

27. The method according to claim 1, further comprising the container (16) containing an identifier (18) by which it is assigned to a sewing station (15).

28. The method according to claim 1, further comprising a carriage (30) supporting the camera (23).

* * * * *